US006609541B1

(12) United States Patent
Hall

(10) Patent No.: US 6,609,541 B1
(45) Date of Patent: Aug. 26, 2003

(54) METHOD FOR ASSEMBLING AND FILLING DEVICE A FLUID DISPENSER PRODUCT

(75) Inventor: Chiis Hall, Le Mesnil Saint Denis (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/936,569

(22) PCT Filed: Mar. 14, 2000

(86) PCT No.: PCT/FR00/00615

§ 371 (c)(1),
(2), (4) Date: Sep. 14, 2001

(87) PCT Pub. No.: WO00/55590

PCT Pub. Date: Sep. 21, 2000

(30) Foreign Application Priority Data

Mar. 16, 1999 (FR) ..... 99 03198

(51) Int. Cl.[7] ..... B65B 3/04

(52) U.S. Cl. ..... 141/3; 141/20; 141/59; 141/83; 141/196; 73/45; 73/52

(58) Field of Search ..... 141/3, 18, 20, 141/21, 59, 83, 100, 129, 196; 73/40, 45, 52

(56) References Cited

U.S. PATENT DOCUMENTS

| | | | | |
|---|---|---|---|---|
| 3,091,958 A | | 6/1963 | Robins | |
| 3,930,401 A | | 1/1976 | Filler | |
| 5,307,685 A | | 5/1994 | Bloome et al. | |
| 5,507,420 A | * | 4/1996 | O'Neill | 222/635 |
| 6,041,573 A | * | 3/2000 | Richardson et al. | 53/403 |

FOREIGN PATENT DOCUMENTS

DE 42 39 238 A 5/1994

* cited by examiner

*Primary Examiner*—Timothy L. Maust
(74) *Attorney, Agent, or Firm*—Sughrue Mion, PLLC

(57) ABSTRACT

A method of assembling and filling a dispenser device for dispensing a fluid substance made up of an active substance and of a propellant. The device includes a receptacle and a dispenser member, such as a metering valve, for dispensing the fluid substance. The method is characterized in that it includes the steps of assembling the dispenser member onto the receptacle in leaktight manner; inserting a determined quantity of propellant into the receptacle and/or into the dispenser member; storing the dispenser device for a determined storage time; checking and/or testing the dispenser devices so as to discard any devices that have defects; and filling the active substance to be dispensed only into those devices which have satisfied the checking and/or testing.

10 Claims, No Drawings

METHOD FOR ASSEMBLING AND FILLING DEVICE A FLUID DISPENSER PRODUCT

The present invention relates to a method of assembling and filling a fluid dispenser device, and it applies more particularly to dispenser devices containing an active substance mixed with or dissolved in a propellant.

A dispenser device for dispensing a fluid substance including a propellant generally comprises a receptacle containing both the substance to be dispensed and the propellant, and a dispenser member such as a metering valve mounted on said receptacle and suitable for selectively dispensing the substance contained therein. Between the metering valve and the receptacle, and inside said valve, sealing gaskets seal the device so as to prevent any leakage of the substance and/or of the propellant.

The usual method of assembling and filling such a dispenser device consists in fixing the valve to the receptacle, in particular by crimping, in filling the receptacle with the substance to be dispensed and with the propellant, and then in storing the assembled and filled device for a determined duration in order to identify any devices that have sealing defects such as leaks.

That method suffers from certain drawbacks. Firstly, the checking for sealing defects is performed on devices that are full of the substance to be dispensed. If a leak is detected, the device in question is discarded so that the active substance that it contains is also lost. That can be a major drawback when the substance is expensive, which applies in particular to certain pharmaceuticals. Similarly, storing devices filled with the substance can pose cost problems because a device that has a high value is "tied up". In addition, it is frequent for the manufacturer of the device to be different from the manufacturer of the active substance to be dispensed by the dispenser. In which case, the manufacturer of the metering valve delivers its valves to its customer who must then perform all of the remaining steps of the assembling and filling method. In which case, the manufacturer of the substance must have access to the tools appropriate for assembling the device and to the means for storing the devices and for checking them after the storage period.

An object of the present invention is to provide a method of assembling and filling a dispenser device for dispensing a fluid substance including a propellant, which method does not suffer from the above-mentioned drawbacks.

Another object of the present invention is to provide such an assembling and filling method that is less costly to perform and that increases the efficiency of the line for filling the devices.

Another object of the present invention is to provide such an assembling and filling method in which a large proportion of the method, in particular assembly, leak testing, and quality control, is performed on the site of the manufacturer of the dispenser device.

The present invention thus provides a method of assembling and filling a dispenser device for dispensing a fluid substance made up of an active substance and of a propellant, said device comprising a receptacle and a dispenser member, such as a metering valve, for dispensing said fluid substance, said method being characterized in that it comprises the following steps:

assembling said dispenser member onto said receptacle in leaktight manner;

inserting a determined quantity of propellant into the receptacle and/or into the dispenser member;

storing the dispenser device for a determined storage time;

checking and/or testing the dispenser devices so as to discard any devices that have defects; and filling the active substance to be dispensed only into those devices which have satisfied said checking and/or testing.

The method of the present invention thus makes it possible to check the leaktightness of the assembled devices before they are filled with the active substance, which offers a very considerable economic advantage, particularly when the active substances are costly. Thus, the efficiency of the final filling line for filling the device is considerably increased and the losses of said active substance due to sealing defects in the dispenser device are largely eliminated. In addition, if the manufacturer of the substance is not the manufacturer of the dispenser device, then the substance manufacturer handles the filling only, and does not need to have access to the means required for assembling the device.

In order to check the leaktightness before the device is finally filled, the present invention makes provision to store the assembled device preferably for a period in the range 7 days to 28 days, with a certain determined quantity of propellant, such as hydrofluoro-alkane (HFA) gas, contained in the device. This solution is inexpensive and very effective. The appropriate quantity of propellant is determined to guarantee that the sealing gaskets are put into a sealing condition, and in particular that said gaskets swell when in contact with said propellant during said storage period. By weighing the dispenser devices before and after storage, it is possible to determine which devices have unacceptable leaks. Only those devices which are properly leaktight are then delivered to the active substance manufacturer, who then merely fills the sealed devices with the substance and with the appropriate propellant. Naturally, although a storage period of 28 days is often advantageous, the storage period may be varied in any desired manner. Similarly, the leaktightness of the devices after storage may be checked in any appropriate manner.

In addition, during or after the storage period, the device may also be tested to check other characteristics of the device. Thus, the metering accuracy, i.e. the volume dispensed each time the device is actuated, may also be checked. Furthermore, the spray quality achieved when the device is actuated may also be checked. It is also possible to look for any presence of contamination of the substance, such as bacterial contamination of said substance. In this way, only those devices that do not have any defects, i.e. that have passed the various quality tests and checks, are filled with the active substance. Naturally, checks or tests other than those described above may be performed during or after the storage period.

Prior to being stored for checking and/or testing purposes, the device may be prepared in various manners. Thus, the receptacle and/or the metering valve may be filled with the determined quantity of propellant before, after, or at the same time as the metering valve is assembled onto the receptacle. In particular, the receptacle is advantageously purged with the propellant before the device is assembled. The metering valve is advantageously assembled onto the receptacle by crimping, but any other suitable assembly technique may also be considered.

What is claimed is:

1. A method of assembling and filling a dispenser device for dispensing a fluid substance made up of an active substance and of a propellant, said device comprising a receptacle and a dispenser member for dispensing said fluid substance, said method being characterized in that it comprises the following steps:

assembling said dispenser member onto said receptacle in leaktight manner;

inserting a determined quantity of propellant into the receptacle and/or into the dispenser member;

storing the dispenser device for a determined storage time;

checking and/or testing the dispenser device so as to discard the dispenser device when a defect is detected; and filling the active substance to be dispensed into the device when the device satisfies said checking and/or testing.

2. A method according to claim 1, in which the step of inserting a determined quantity of propellant is performed before the step of assembling the dispenser member onto the receptacle.

3. A method according to claim 1, in which the step of inserting a determined quantity of propellant comprises purging the receptacle with the propellant.

4. A method according to claim 1, in which the storing step is performed for a storage time approximately in the range 7 days to 28 days.

5. A method according to claim 1, in which the checking step comprises weighing the dispenser before and after the storage time to detect and discard the dispenser when it has sealing defects.

6. A method according to claim 1, in which the testing step comprises testing the metering accuracy and/or the spray quality, and/or the presence of any contamination of the substance.

7. A method according to claim 1, in which said assembling step is performed by crimping the dispenser member onto the receptacle.

8. A method according to claim 1, in which the determined quantity of propellant inserted into the receptacle and/or into the dispenser member before the storage time, and the duration of the storage time are suitable for putting the sealing gaskets into a sealing condition, in particular by said gaskets swelling when in contact with said propellant.

9. The method according to claim 1, wherein the dispenser member is a metering valve.

10. The method according to claim 1, further comprising performing the assembling, inserting, storing, checking and/or testing, and filling steps for a plurality of additional dispenser devices for dispensing the fluid substance made up of the active substance and of the propellant.

* * * * *